US005238247A

United States Patent [19]

Davis

[11] Patent Number: 5,238,247

[45] Date of Patent: Aug. 24, 1993

[54] MONO-SHAFT SPORTS RACQUET

[75] Inventor: Stephen J. Davis, Washington Crossing, Pa.

[73] Assignee: Prince Manufacturing, Inc., Lawrenceville, N.J.

[21] Appl. No.: 849,909

[22] Filed: Mar. 12, 1992

[51] Int. Cl.[5] ..... A63B 49/02

[52] U.S. Cl. ..... 273/73 G

[58] Field of Search ..... 273/73 R, 73 C, 73 D, 273/73 G, 73 H, 73 K

[56] References Cited

U.S. PATENT DOCUMENTS

| | | | |
|---|---|---|---|
| 4,575,084 | 3/1986 | Yoneyama | 273/73 G |
| 4,989,871 | 2/1991 | Sheng | 273/73 G |
| 5,006,298 | 4/1991 | Tsai | 273/73 G |
| 5,071,124 | 12/1991 | Davis | 273/73 G |

FOREIGN PATENT DOCUMENTS

| | | | |
|---|---|---|---|
| 3016072 | 10/1981 | Fed. Rep. of Germany | 273/73 G |
| 2026327 | 2/1980 | United Kingdom | 273/73 G |
| 2148722 | 6/1985 | United Kingdom | 273/73 G |

*Primary Examiner*—V. Millin
*Assistant Examiner*—Raleigh W. Chiu
*Attorney, Agent, or Firm*—White & Case

[57] ABSTRACT

A sports racquet, preferably a squash racquet, has a Y-joint joining a head profile and a shaft. The Y-joint includes a pair of arms for receiving the ends of the head profile, and a base for receiving the shaft. The arms and base each include an outwardly open, annular channel, preferably formed by a pair of concentric sleeves, in which the tubular ends of the head portion and shaft are secured.

5 Claims, 2 Drawing Sheets

MONO-SHAFT SPORTS RACQUET

FIELD OF THE INVENTION

The present invention relates to sports racquets of the type having a frame defining a stringing area, in which a head portion is connected to a shaft in the form of a single profile tube. The invention is particularly applicable to squash racquets, but may also be utilized with other types of racquets such as badminton and tennis racquets.

BACKGROUND OF THE INVENTION

Present day squash racquets are formed from a continuous hollow tube member made of metal or fiber-reinforced resin. The tube member is bent (in the case of a metal tube member) or heat molded (in the case of resin) to define a generally oval head portion for the strings, and the opposite ends of the tube member converge to form a shaft, on which a handle is formed.

In conventional squash racquets, a throat piece is disposed across the lower portion of the head area, and is used to anchor the lower portion of the strings. More recently, Prince Manufacturing, Inc. introduced the Extender ® squash racquet, in which there is no throat piece and the stringing area is extended down into the throat area. In either case, however, the converging tube members meet in generally a Y-shape configuration, and then extend side-by-side, as a double shaft, to the handle.

U.S. Pat. No. 3,431,626 discloses a badminton racquet and a squash racquet in which the ends of the tube forming the head portion are joined to a single shaft member, or mono-shaft, rather than a double shaft. This is done either by welding the ends of the head portion to a separate shaft member, or by extending one of the tubes (rather than both tubes) to form a shaft.

U.K. patent application No. 2,026,327 discloses a badminton racquet which is forming using a separate throat piece which joins the head to the shaft. The throat piece, which may be made of magnesium alloy, aluminum or plastic, is of Y-shape, and the three extending portions (two arms and the base) are each in the form of a hollow sleeve. The throat piece joins the ends of a metal frame head portion with a metal shaft, preferably by securing the ends of the head portion and shaft within the three tubular sleeves of the Y-member.

During play, the stress applied to the throat area of a squash or tennis racquet frame is substantially higher than in a badminton racquet. Thus, it would be desirable to provide an improved Y-joint for use particularly in squash racquets, but for use in other racquets as well.

SUMMARY OF THE INVENTION

The present invention is a mono-shaft racquet for use in squash or other sports, including a tubular profile member forming the head and having opposite ends converging in a throat area, a tubular shaft, and a Y-joint connecting the head and shaft. The Y-joint comprises a base and a pair of arms diverging outwardly from the base in a general Y-shape configuration. Each of the arms is provided with an outwardly opening, annular channel, oriented about an axis generally parallel to the axis of the arm, for receiving one of the two ends of the tubular head portion. Similarly, the base has an outwardly open, annular channel, arranged about the base axis, for receiving the upper end of the shaft. Preferably, each of the channels is formed by a pair of concentric sleeves, in which the inner sleeve projects beyond the outer sleeve. The arms may be formed with an outwardly facing stringing groove, and one or more stringing holes extend through the arm from the bottom of the stringing groove.

Preferably, the head and shaft are formed of metal, whereas the Y-joint is a pre-molded composite material, such as thermoplastic. Preferably also, the annular channel in the base is larger than the annular channels in the arms, to accommodate a shaft with larger dimensions than the head tubular member.

For a better understanding of the invention, reference is made to the following detailed description of a preferred embodiment, taken in conjunction with the drawings accompanying the application.

DETAILED DESCRIPTION OF A PREFERRED EMBODIMENT

Figure 1:
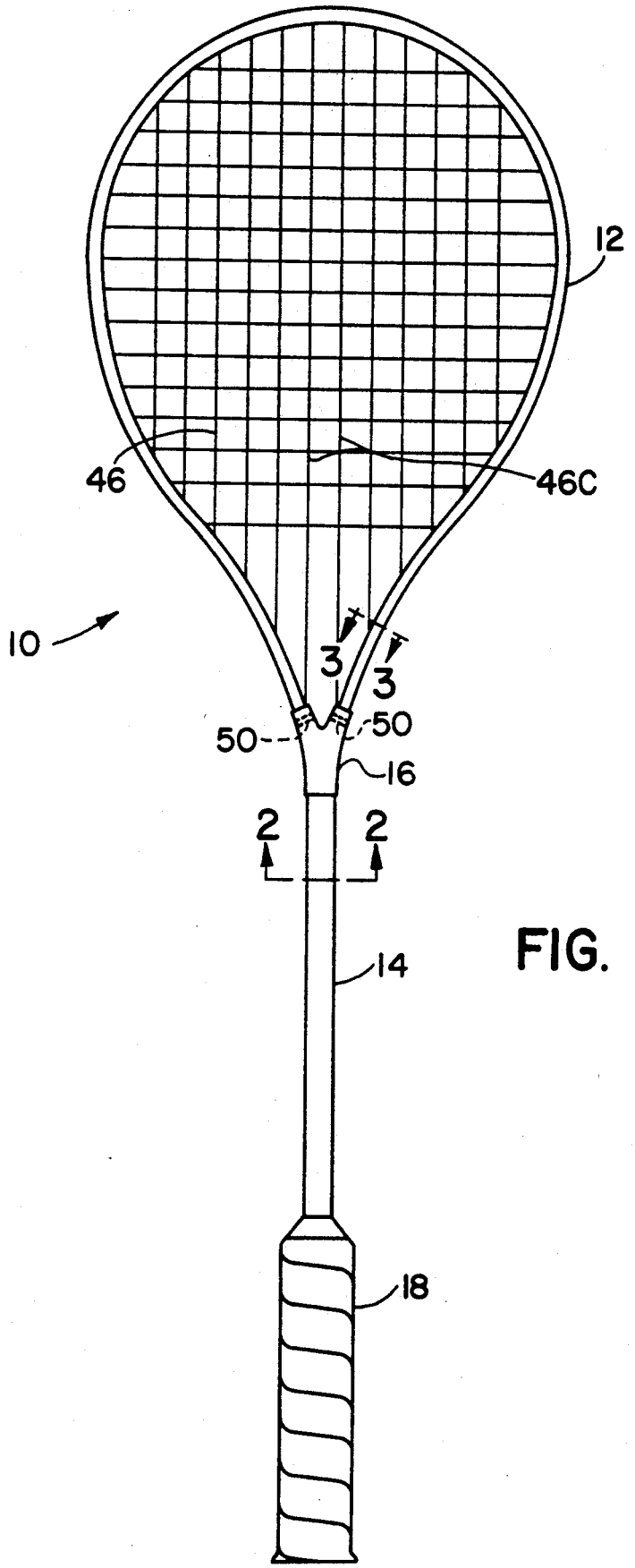
FIG. 1 is a front view of a Y-joint squash racquet according to the invention.

FIG. 1 illustrates a squash racquet 10 which includes a head portion 12 formed by a tubular profile member and a shaft 14 which is formed by a second tubular profile member, and a Y-joint connector 16. A handle 18 may be formed on the shaft 14 in the conventional manner.

Figure 2:
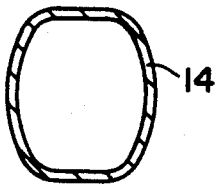
FIGS. 2 and 3 are sectional views taken through lines 2—2 and 3—3 of FIG. 1, respectively.
Figure 3:
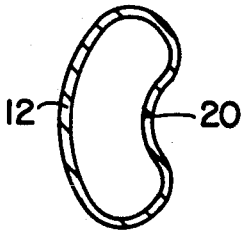

Referring to FIG. 2, it can be seen that the shaft 14 is a mono-shaft, hollow tubular member having a generally oval shape. As illustrated in FIG. 3, the head portion 12 is also a hollow tubular profile, which includes a conventional outwardly facing stringing groove 20 for receiving strings.

Figure 7:
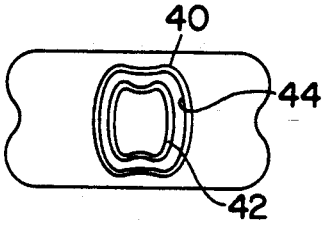
FIG. 6 and 7 are side and bottom views, respectively, of the Y-joint of FIG. 1.
Figure 8:
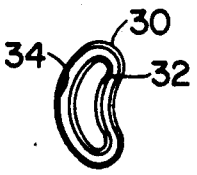
FIG. 8 is a top view of one of the arms of the Y-joint, taken in the direction of arrows 7—7 of FIG. 4.
Figure 4:
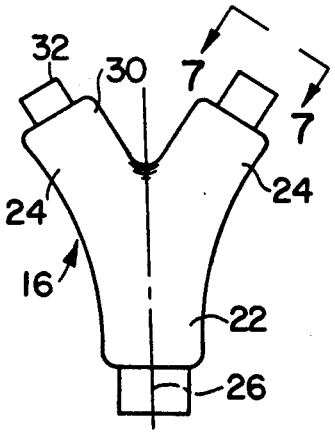
FIG. 4 is a front views of the Y-joint of FIG. 1.
Figure 5:
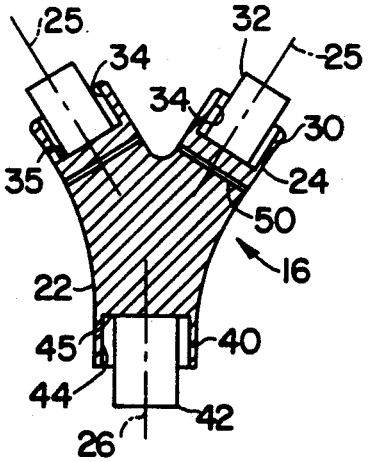
FIG. 5 is a front, sectional view of the Y-joint of FIG. 4.
Figure 6:
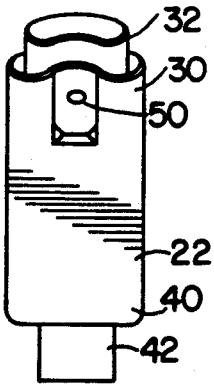

FIGS. 4–8 show the Y-joint in greater detail. Referring to FIGS. 4–5, the Y-joint includes a base portion 22, and a pair of arms 24 that diverge from the axis 26 of the base 22 so as to form generally a Y-shape. In an illustrative embodiment, each arm 24 diverge at an angle of 28° relative to the base axis 26. The outer end of each arm 24 includes a pair of concentric sleeves 30, 32, which define an annular receiving channel 34, as best shown in FIGS. 7 and 8. The channel 34, defined by the space between the inner and outer sleeves 30, 32, is extends along an axis which is parallel to the central axis 25 of the arm 24. The channel 34 extends inwardly for a distance of about 17 mm, and terminates in a seat 35 for the end of the head profile member 12. The inner sleeve 32 projects a distance of about 5 mm beyond the end of the channel 34. The depth of the channel 34, and extension of the inner sleeve 32, can be varied as desired.

The channels 34 are in the same shape as the ends of the head profile portion 12, and extend a sufficient distance down into the arms 24 so as to form receiving sockets for the ends of the head portion 12.

The base portion 22 of the Y-joint 16 similarly includes a pair of coaxial sleeves 40, 42, which define an downwardly open, annular receiving channel 44 for the shaft 14, which extends along the base axis 26, as best shown in FIGS. 5 and 7. As in the case of channels 34, preferably the inner sleeve 42 projects a distance of about 5 mm beyond the end of channel 44, and preferably the channel 44 extends a distance of about 17 mm inwardly and terminates in a seat 45 for the end of the shaft 14.

As is evident from the drawings, the racquet shown in FIG. 1 may be readily assembled by inserting the ends of the head profile member 12 into the respective channels 34 of the two arms 24, until they abut the seats 35. The head 12 may be secured to the Y-joint 16 in any suitable manner, such as by using an adhesive. Similarly, the shaft portion 14 is inserted into the channel 44 in the base 22 until it abuts seat 45, and secured in a suitable manner. The handle 18 is then mounted to complete the racquet frame. Strings 46 are eventually secured to the frame to prepare the racquet for play. As shown in FIG. 1, the center main strings 46c may be anchored through holes 50 formed in the Y-joint, which will further secure the head and Y-joint assembly.

In an exemplary embodiment, the head profile member 12 and shaft 14 are formed of metal, and the Y-joint is molded out of a thermoplastic material. Because the channels 34 and 44 face outwardly from the respective arms and base, the Y-joint 16 can readily be made by injection molding or other suitable techniques. However, if desired, the head portion 12 and shaft 14 may be made of other materials, such as fiber impregnated resin, and either may be the same material as the Y-joint or may constitute different materials from the Y-joint and from each other.

A racquet having a Y-joint construction according to the invention possesses good strength, in that the joining members are securely held in the Y-joint channels. Accordingly, the Y-joint member may be used for racquets such as squash and tennis, as well as badminton.

the foregoing represents a description of a preferred embodiment. Variations and modifications will be apparent to persons skilled in the art, without departing from the inventive concepts shown herein. All such modifications and variations are intended to be within the scope of the invention, as defined in the following claims.

I claim:

1. A Y-joint for the frame of a sports implement, comprising a base having an axis and a pair of arms, having an axis, extending from the base diverging from the axis such that the base and arms form generally a Y-configuration, wherein each said arm and said base have an outwardly open, annular channel oriented to extend generally along its respective axis, and wherein the channels of the arms and of the base are sized to receive the end of a tubular profile member for forming, respectively, a racquet head portion and shaft.

2. A Y-joint as defined in claim 1, wherein said arms and said base each have a pair of concentric sleeves, having a space therebetween for forming the respective channel.

3. A Y-joint as defined in claim 2, wherein the sleeves of each pair comprise an inner sleeve and an outer sleeve, and wherein the inner sleeve extends a distance of approximately 5 mm beyond the channel.

4. A Y-joint as defined in claim 3, wherein the channel extends a distance of approximately 17 mm inwardly from the outer end of the outer sleeve.

5. A sports racquet comprising a head portion with a profile member having opposite ends, wherein at least the ends of the profile member are hollow and tubular;

a shaft having opposite ends, in which at least one end is a hollow, tubular profile; and a Y-joint as defined in claim 1, wherein the ends of the head section are snugly received in the channels of the Y-joint arms, and wherein the end of the shaft is received in the channel of the base.

* * * * *